US006415850B1

(12) United States Patent
Plociennik et al.

(10) Patent No.: US 6,415,850 B1
(45) Date of Patent: Jul. 9, 2002

(54) METHOD OF MEASURING AND REGULATING TEMPERATURE AND QUANTITY OF COOLING WATER FOR WATER-COOLABLE MOLD WALLS OF A CONTINUOUS CASTING MOLD

(75) Inventors: Uwe Plociennik, Ratingen; Meinert Meyer, Erkrath, both of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/377,351

(22) Filed: Aug. 19, 1999

(30) Foreign Application Priority Data

Aug. 24, 1998 (DE) ..... 198 38 331

(51) Int. Cl.[7] ..... B22D 11/22; B22D 11/124
(52) U.S. Cl. ..... 164/485; 164/455
(58) Field of Search ..... 164/485, 455

(56) References Cited

U.S. PATENT DOCUMENTS 4,749,023 A * 6/1988 Draper et al. ..... 164/429

6,152,209 A * 11/2000 Pleschiutschnigg ..... 164/455

* cited by examiner

*Primary Examiner*—M. Alexandra Elve
*Assistant Examiner*—Kevin McHenry
(74) *Attorney, Agent, or Firm*—Friedrich Kueffner

(57) ABSTRACT

A method of measuring and regulating temperature and quantity of cooling water of a continuous casting mold flowing through water-coolable mold walls composed of copper plates, particularly mold walls which are independent of each other, wherein the cooling water temperature of a mold wall is measured at at least two locations in the area of the discharge openings of a copper plate and the corresponding water box. The flow velocity and the water pressure of the cooling system are adjusted in such a way that the lowest temperature in the area of the water discharge side or the water discharge opening of a copper plate is at the limit of the boiling temperature, and that for all higher temperatures a bubble evaporation at subcooled boiling of the cooling water is stimulated.

1 Claim, No Drawings

METHOD OF MEASURING AND REGULATING TEMPERATURE AND QUANTITY OF COOLING WATER FOR WATER-COOLABLE MOLD WALLS OF A CONTINUOUS CASTING MOLD

BACKGROUND OF THE INVENTION

1. Field of the Invention

The present invention relates to a method of measuring and regulating temperature and quantity of cooling water of a continuous casting mold flowing through water-coolable mold walls composed of copper plates, particularly mold walls which are independent of each other, wherein the cooling water temperature of a mold wall is measured at at least two locations in the area of the discharge openings of a copper plate and the corresponding water box.

2. Description of the Related Art

A method of the above-described type is operated in such a way that cooling water supply bores act together to form the water supply into cooling ducts of the mold wall, while the sum of discharge bores of the cooling ducts together form the water discharge, wherein the supplied temperature of the cooling water is measured, the difference between supply temperature and discharge temperature is determined, and the cooling water quantity per unit of time is used for determining the partial integral heat discharge from a mold or from a mold wall portion; a temperature profile is then determined and the temperature profiles obtained over time intervals are compared and partial inequalities are compensated by partial quantity corrections of the cooling water.

When designing the mold cooling unit, usually the flow velocity and the water pressure at the outlet side of the water cooling system are selected in such a way that for the hottest location of the mold the temperatures at the surface of the cooling duct are below the boiling temperature of the water corresponding to the discharge pressure. Occurring at the surface facing the strand in the area of the meniscus is a different thermal load which leads to different melting behavior of the casting powder and, thus, to inequalities in the formation of the strand shell which is still very sensitive.

SUMMARY OF THE INVENTION

It is the primary object of the present invention to further develop and improve the prior art method disclosed in U.S. Pat. application Ser. No. 09/082,884 and to achieve by targeted cooling an equalization of the temperature distribution in the area of the meniscus of molds, particularly of molds for casting thin slabs.

In accordance with the present invention, the flow velocity and the water pressure of the cooling system are adjusted in such a way that the lowest temperature in the area of the water discharge side or the water discharge opening of a copper plate is at the limit of the boiling temperature, and that for all higher temperatures a bubble evaporation at subcooled boiling of the cooling water is stimulated.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are described preferred embodiments of the invention.

DETAILED DESCRIPTION OF THE INVENTION

The method according to the present invention provides the major advantage that the thermal flux density at the heat transition from the metal bath through the copper mold wall to the cooling medium water is significantly increased because of the high consumption of evaporation heat for the bubble evaporation, and, with increasingly exceeding the boiling temperature, the thermal flux density is further increased by a corresponding intensification of the bubble evaporation in such a way that the temperature differences over the width of the mold are significantly reduced.

This makes it possible to equalize the temperature distribution in the area of the meniscus of molds by a targeted cooling of the mold walls and, thus, also of the metal bath, by means of the subcooled boiling of the cooling medium water. This further results at the surfaces of the copper plates forming the mold in an equalization of the thermal load which provides the result that the casting powder is melted more uniformly and the strand shell is also locally formed more uniformly during its thermal contact with the copper plates of the mold.

A particular contribution to this advantageous result is the fact that, as the boiling temperature is being exceeded, the bubble evaporation interacts with an analogous intensification while increasing the thermal flux density. For this purpose, the method may be carried out in such a way that the flow velocity and the cooling medium pressure in the cooling ducts are adjusted to be constant, such that an increased thermal load is compensated by a correspondingly increased bubble evaporation.

The diagram shown in the drawing further explains the results obtained by the present invention, wherein the thermal flux density is plotted on the ordinate and the overheating temperature is plotted on the abscissa, wherein $W_1$ and $W_2$ denote the water velocity higher and lower thermal flux densities, $W_1<W_2$ denotes the difference in thermal flux densities, $T_w$ denotes the water temperature and $T_s$ the boiling temperature, and $T_w-T_s$ denotes the overheating temperature.

While specific embodiments of the invention have been described in detail to illustrate the inventive principles, it will be understood that the invention may be embodied otherwise without departing from such principles.

We claim:

1. A method of measuring and regulating temperature and quantity of cooling water of a continuous casting mold flowing per unit of time through water coolable mold walls composed of copper plates, particularly mold walls which are independent of each other, the method comprising measuring a cooling water temperature of a mold wall at at least two locations in an area of a discharge opening of a mold wall and a corresponding water box, adjusting a flow velocity and a water pressure of the cooling water in an area of water discharge openings of the copper plate, such that a portion of water discharging from the mold at the water discharge openings has a temperature at the boundary of the boiling temperature, and all other portions of water discharging from the mold at higher temperatures undergo bubble evaporation causing subcooled boiling of the cooling water, further comprising adjusting the flow velocity and the cooling water pressure in the cooling ducts so as to be constant, such that an increased thermal load is compensated by a correspondingly increased bubble evaporation.

* * * * *